US011629572B2

(12) United States Patent
Al-Marri et al.

(10) Patent No.: US 11,629,572 B2
(45) Date of Patent: Apr. 18, 2023

(54) SURFACE SAFETY VALVE

(71) Applicant: Saudi Arabian Oil Company, Dhahran (SA)

(72) Inventors: Hamad Al-Marri, An'Nuayriyah (SA); James Arukhe, Dhahran (SA); Ammal F. Al-Anazi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/401,055

(22) Filed: Aug. 12, 2021

(65) Prior Publication Data

US 2023/0050658 A1 Feb. 16, 2023

(51) Int. Cl.
*E21B 33/068* (2006.01)
*E21B 34/02* (2006.01)

(52) U.S. Cl.
CPC ..... *E21B 33/068* (2013.01); *E21B 34/025* (2020.05)

(58) Field of Classification Search
CPC ..... E21B 33/068; E21B 34/02; E21B 34/025
See application file for complete search history.

(56) References Cited

U.S. PATENT DOCUMENTS 3,933,338 A 1/1976 Herd et al.
4,809,733 A * 3/1989 Hawkins ..... F16K 31/1221 92/60

(Continued)

FOREIGN PATENT DOCUMENTS

WO WO 9967500 12/1999
WO WO 2012093312 7/2012

OTHER PUBLICATIONS

"Magnum Line Pressure Operated Surface Safety Gate Valve," WOM SSV Actuator Catalog, 2020 4 pages.

(Continued)

*Primary Examiner* — Matthew R Buck
(74) *Attorney, Agent, or Firm* — Fish & Richardson P.C.

(57) ABSTRACT

A surface safety valve for a well system includes a main valve body with a central bore through it. The main valve body has a centerline axis and is configured to be connected at a surface location above a surface of the Earth to a surface assembly of the well system and to receive through the central bore a flow of wellbore fluid from a subterranean zone conveyed by a production tubing. A gate is positioned within the main valve body and is configured to move from an open position in which the gate does not block flow of wellbore fluid through the central bore to a closed position in which the gate blocks flow of wellbore fluid through the central bore. The gate travels from the open position to the closed position along a gate movement axis perpendicular to the centerline bore axis. The gate includes a gate front end positioned on a first side of the centerline bore axis and a gate back end positioned on a second side of the centerline bore axis opposite the first side. The surface safety valve also includes an actuator positioned on the first side of the centerline bore axis. The actuator is configured to selectively push the gate towards the open position. The safety valve also includes a spring enclosed within the main valve body and positioned on the second side of the centerline bore axis. The spring is connected to the gate back end and is configured to bias the gate towards the closed position.

12 Claims, 3 Drawing Sheets

(56) References Cited

U.S. PATENT DOCUMENTS

| | | | | |
|---|---|---|---|---|
| 6,145,594 | A * | 11/2000 | Jones | E21B 33/062 166/368 |
| 6,491,102 | B2 | 12/2002 | Leismer et al. | |
| 6,823,271 | B1 | 11/2004 | Foss | |
| 6,923,423 | B2 * | 8/2005 | Jones | E21B 34/02 251/360 |
| 6,953,084 | B2 | 10/2005 | Greeb et al. | |
| 8,372,248 | B1 | 2/2013 | Sherry | |
| 8,641,813 | B2 | 2/2014 | Gysling | |
| 9,470,057 | B2 * | 10/2016 | Herland | E21B 34/04 |
| 10,450,833 | B2 * | 10/2019 | Hall | E21B 33/038 |
| 2012/0168364 | A1 | 7/2012 | Evans | |
| 2013/0313191 | A1 | 11/2013 | Wolf et al. | |
| 2017/0349455 | A1 | 12/2017 | Katz | |

OTHER PUBLICATIONS

"Omni Valve SSV Actuators," Omni Valve Catalog, 2020, 5 pages.
Golden, "Low-Surface Safety Valve Control System Pressures Improve Economy and Safety in Offshore Operations," SPE-22804-MS, presented at the SPE Annual Technical Conference and Exhibition, Dallas, Texas, Oct. 1991, 8 pages.
Moelyono et al., "Automatic Control Surface Safety Valve: Low Cost Solution to Optimise Production," SPE-186958-MS, presented at the SPE/IATMI Asia Pacific Oil & Gas Conference and Exhibition, Jakarta, Indonesia, Oct. 2017, 9 pages.
PCT International Search Report and Written Opinion in International Appln. No. PCT/US2022/074885, dated Nov. 3, 2022, 15 pages.

* cited by examiner

SURFACE SAFETY VALVE

TECHNICAL FIELD

This disclosure relates to a valve for a wellhead of a well, and in particular a surface safety valve, system, and method.

BACKGROUND

Surface safety valves provide a fail-safe closure to prevent the escape of fluids from a well system in the event of an emergency or other abnormal condition. A surface safety valve is typically part of a Christmas tree surface assembly at a wellhead.

SUMMARY

This disclosure describes a wellhead surface safety valve, system, and method.

Certain aspects of the subject matter herein can be implemented as a surface safety valve for a well system. The surface safety valve includes a main valve body with a central bore through it. The main valve body has a centerline bore axis and is configured to be connected at a surface location above a surface of the Earth to a surface assembly of the well system and to receive through the central bore a flow of wellbore fluid from a subterranean zone conveyed by a production tubing. A gate is positioned within the main valve body and is configured to move from an open position in which the gate does not block flow of wellbore fluid through the central bore to a closed position in which the gate blocks flow of wellbore fluid through the central bore. The gate travels from the open position to the closed position along a gate movement axis perpendicular to the centerline bore axis. The gate includes a gate front end positioned on a first side of the centerline bore axis and a gate back end positioned on a second side of the centerline bore axis opposite the first side. The surface safety valve also includes an actuator positioned on the first side of the centerline bore axis. The actuator is configured to selectively push the gate towards the open position. The safety valve also includes a spring enclosed within the main valve body and positioned on the second side of the centerline bore axis. The spring is connected to the gate back end and is configured to bias the gate towards the closed position.

An aspect combinable with any of the other aspects can include the following features. The surface safety valve of claim 1, wherein the main valve body is a one-piece valve body.

An aspect combinable with any of the other aspects can include the following features. The spring is enclosed entirely within the main valve body.

An aspect combinable with any of the other aspects can include the following features. The actuator includes a hydraulic cylinder that pushes the gate towards the open position in response to a charging of the hydraulic cylinder with hydraulic pressure.

An aspect combinable with any of the other aspects can include the following features. The spring is operable to push the gate to the closed position in response to a loss of hydraulic pressure to the hydraulic cylinder.

An aspect combinable with any of the other aspects can include the following features. The actuator is enclosed within an external actuator housing attached to the main valve body.

An aspect combinable with any of the other aspects can include the following features. The spring remains operable to bias the gate towards the closed position when the actuator or actuator housing are damaged or disconnected from the main valve body.

An aspect combinable with any of the other aspects can include the following features. The spring is a coil spring.

An aspect combinable with any of the other aspects can include the following features. The gate includes a fluid passage to allow wellbore fluid flow through the gate when the gate is in the open position.

An aspect combinable with any of the other aspects can include the following features. The actuator is an electric actuator.

Certain aspects of the subject matter herein can be implemented as a well system. The well system includes a production tubing positioned within a well and configured to carry fluids produced from a subterranean zone to a wellhead. The well system also includes a surface assembly at a surface location above a surface of the Earth and proximate the wellhead. The surface assembly is configured to regulate a flow of fluid from the production tubing and includes a surface safety valve. The surface safety valve includes a main valve body with a central bore therethrough. The central bore has a centerline bore axis and is fluidically coupled to a production tubing of the well proximate to the wellhead. The surface safety valve also includes a gate positioned within the main valve body. The gate is configured to move from an open position in which the gate does not block flow of wellbore fluid through the central bore to a closed position in which the gate blocks flow of wellbore fluid through the central bore. The gate travels from the open position to the closed position along a gate movement axis perpendicular to the centerline bore axis. The gate includes a gate front end positioned on a first side of the centerline bore axis and a gate back end positioned on a second side of the centerline bore axis opposite the first side. The surface safety valve also includes an actuator positioned on the first side of the centerline bore axis. The actuator is configured to selectively push the gate towards the open position. The surface safety valve also includes a spring enclosed within the main valve body and positioned on the second side of the centerline bore axis. The spring is connected to the gate back end and is configured to bias the gate towards the closed position.

An aspect combinable with any of the other aspects can include the following features. The main valve body is a one-piece valve body.

An aspect combinable with any of the other aspects can include the following features. The spring is enclosed entirely within the main valve body.

An aspect combinable with any of the other aspects can include the following features. The actuator includes a hydraulic cylinder that pushes the gate towards the open position in response to a charging of the hydraulic cylinder with hydraulic pressure.

An aspect combinable with any of the other aspects can include the following features. The spring is operable to push the gate to the closed position in response to a loss of hydraulic pressure to the hydraulic cylinder.

An aspect combinable with any of the other aspects can include the following features. The actuator is enclosed within an external actuator housing attached to the main valve body.

An aspect combinable with any of the other aspects can include the following features. The spring remains operable to bias the gate towards the closed position when the actuator or actuator housing are damaged or disconnected from the main valve body.

An aspect combinable with any of the other aspects can include the following features. The spring is a coil spring.

An aspect combinable with any of the other aspects can include the following features. The gate includes a fluid passage to allow wellbore fluid flow through the gate when the gate is in the open position.

An aspect combinable with any of the other aspects can include the following features. The actuator is an electric actuator.

Certain aspects of the subject matter herein can be implemented as a method. The method includes connecting, to a surface assembly configured to regulate a flow of wellbore fluid from a production tubing of a well, a surface safety valve. The surface safety valve includes a main valve body with a central bore therethrough. The central bore has a central bore axis and is fluidically coupled to a production tubing of the well. The surface safety valve also includes a gate positioned within the main valve body. The gate is configured to move from an open position in which the gate does not block flow of wellbore fluid through the central bore to a closed position in which the gate blocks flow of wellbore fluid through the central bore. The gate travels from the open position to the closed position along a gate movement axis perpendicular to the centerline bore axis. The has a gate front end positioned on a first side of the centerline bore axis and a gate back end positioned on a second side of the centerline bore axis opposite the first side. The surface safety valve also includes an actuator connected to the gate front end and positioned on the first side of the centerline bore axis. The actuator is configured to selectively push the gate towards the open position. The surface safety valve also includes a spring enclosed within the main valve body and positioned on the second side of the centerline bore axis. The spring is connected to the gate back end and is configured to bias the gate towards the closed position. The method also includes opening the subsurface safety valve by activating the actuator, thereby pushing the gate to the open position.

An aspect combinable with any of the other aspects can include the following features. The main valve body is a one-piece valve body.

An aspect combinable with any of the other aspects can include the following features. The spring is enclosed entirely within the main valve body.

An aspect combinable with any of the other aspects can include the following features. The actuator includes a hydraulic cylinder, and activating the actuator includes charging the hydraulic cylinder with hydraulic pressure.

An aspect combinable with any of the other aspects can include the following features. The method also includes pushing, by the spring, the gate to the closed position in response to a loss of hydraulic pressure to the hydraulic cylinder.

An aspect combinable with any of the other aspects can include the following features. The actuator is enclosed within an external actuator housing attached to the main valve body.

An aspect combinable with any of the other aspects can include the following features. The spring remains operable to bias the gate towards the closed position when the actuator or actuator housing are damaged or disconnected from the main valve body.

An aspect combinable with any of the other aspects can include the following features. The spring is a coil spring.

An aspect combinable with any of the other aspects can include the following features. The gate includes a fluid passage to allow wellbore fluid flow through the gate when the gate is in the open position.

An aspect combinable with any of the other aspects can include the following features. The actuator is an electric actuator.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

The present disclosure is directed to a wellhead valve. Particularly, the present disclosure is directed to a wellhead surface safety valve, system and method.

A surface safety valve (SSV) can be installed as part of the "Christmas tree" surface system at a wellbore. A SSV can include a gate actuated by an actuator (such as a hydraulic actuator) which pushes the gate to an open position, with the force of the actuator pushing against a spring which biases the gate towards the closed position. In the event of an emergency or other condition, hydraulic pressure or power can be cut off from the actuator, such that the spring pushes the valve to the closed position, thus reducing or eliminating the loss of wellbore fluids to the environment or to other undesired areas. Some SSVs enclose the spring within the same external housing as the actuator or within another external housing.

Because of their size and location as part of a surface assembly, SSVs and their associated equipment can be exposed to risk from damaging impacts from other equipment. Complicated and multi-part SSV components can be at risk for corrosion and can be complicated and expensive to install and maintain.

In some embodiments of the present disclosure, the spring biasing the gate to the closed position is located within the main valve body, opposite (across the central bore axis from) the actuator. The risk to damage to the spring can thus be reduced, and damage to the actuator or actuator housing (such as, for example, a disconnection of the actuator from the SSV main body) would not affect the operation or function of the spring.

In some embodiments, the spring is located entirely within the main valve body, which in some embodiments can be a one-piece valve body. The result can be a valve that is shorter in length or otherwise smaller in overall size, thus reducing the space requirements for the SSV and reducing risks from impacts and collisions from other wellsite equipment. The load carrying capacity and rigidity of the SSV can also be greater in such a design. Compared to designs with a spring placed in an external housing, the SSV in accordance with some embodiments of the present disclosure can have fewer seals, o-rings, flanges, and other parts and can be installed in the field with less reliance on wrenches or other tools, which improves uptime during hook up in the field.

In some embodiments of the present disclosure, the risk of corrosion can be reduced as there is no separate flanged part to house the spring actuator or corresponding threads and housing connections. The coating (external and/or internal) on the SSV body can minimize exposure of the internal parts of the actuator to harsh conditions of the environment. Consequently, redressing and maintenance can also be easier and done more quickly.

Figure 1:
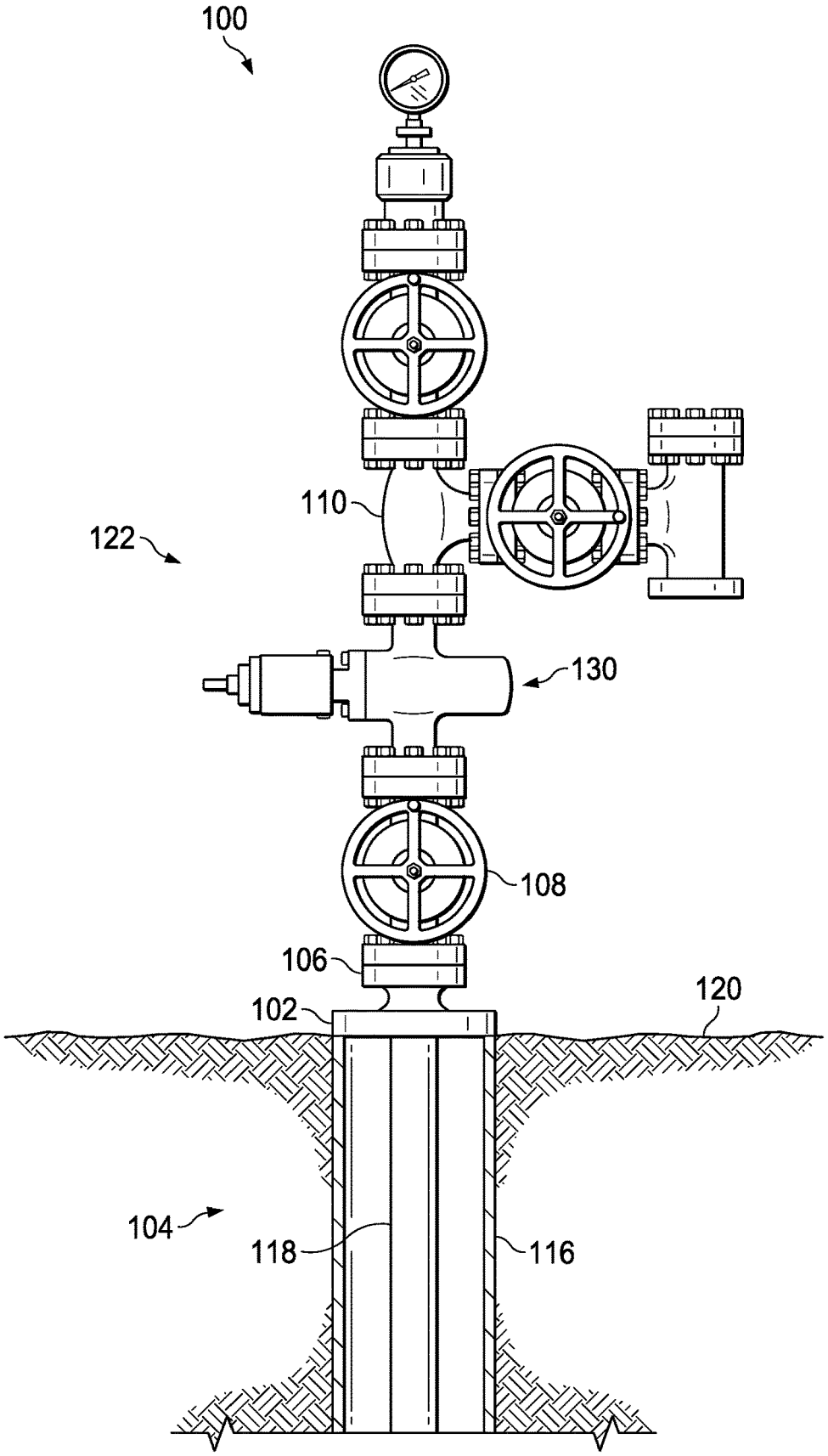
FIG. 1 is a schematic diagram of a well system including a surface safety valve in accordance with an embodiment of the present disclosure.

FIG. 1 is a schematic diagram of a well system including a surface safety valve in accordance with an embodiment of the present disclosure. Referring to FIG. 1, well system 100 includes a well 104 drilled into a subterranean zone or zones. Wellbore fluids (such as gas and oil) can be produced from the subterranean zone or zones through production tubing 118 within casing 116 up to wellhead 102 at the surface end of well 104. Well system 100 further includes a surface assembly 122 (which can be called a "Christmas tree") above the surface 120 of the Earth and proximate wellhead 102. In the illustrated embodiment, surface assembly 122 includes tubing hanger and casing head 106 which connect the upper ends of casing 116 and production tubing 118 to master valve 108, and can includes various other valves, spools, pressure gauges and chokes to regulate and control production of the wellbore fluids from well 104. Wellbore fluids can exit surface assembly 122 at production wing 110 to be conveyed towards pipelines or other surface treatment, gathering, or conveyance facilities.

In the illustrated embodiment, surface assembly 122 includes a SSV 130 installed above master valve 108 and below production wing 110. As described in further detail in reference to FIGS. 2A and 2B, surface safety valve 130 can selectively allow the flow of wellbore fluids through well system 100 and features a fail-safe mechanism which shuts off the flow in the event of an emergency or other situation in which such a fail-safe shut off is desirable. In embodiments of the present disclosure, surface safety valve 130 can be installed at other suitable locations as part of a well system.

Figure 2A:
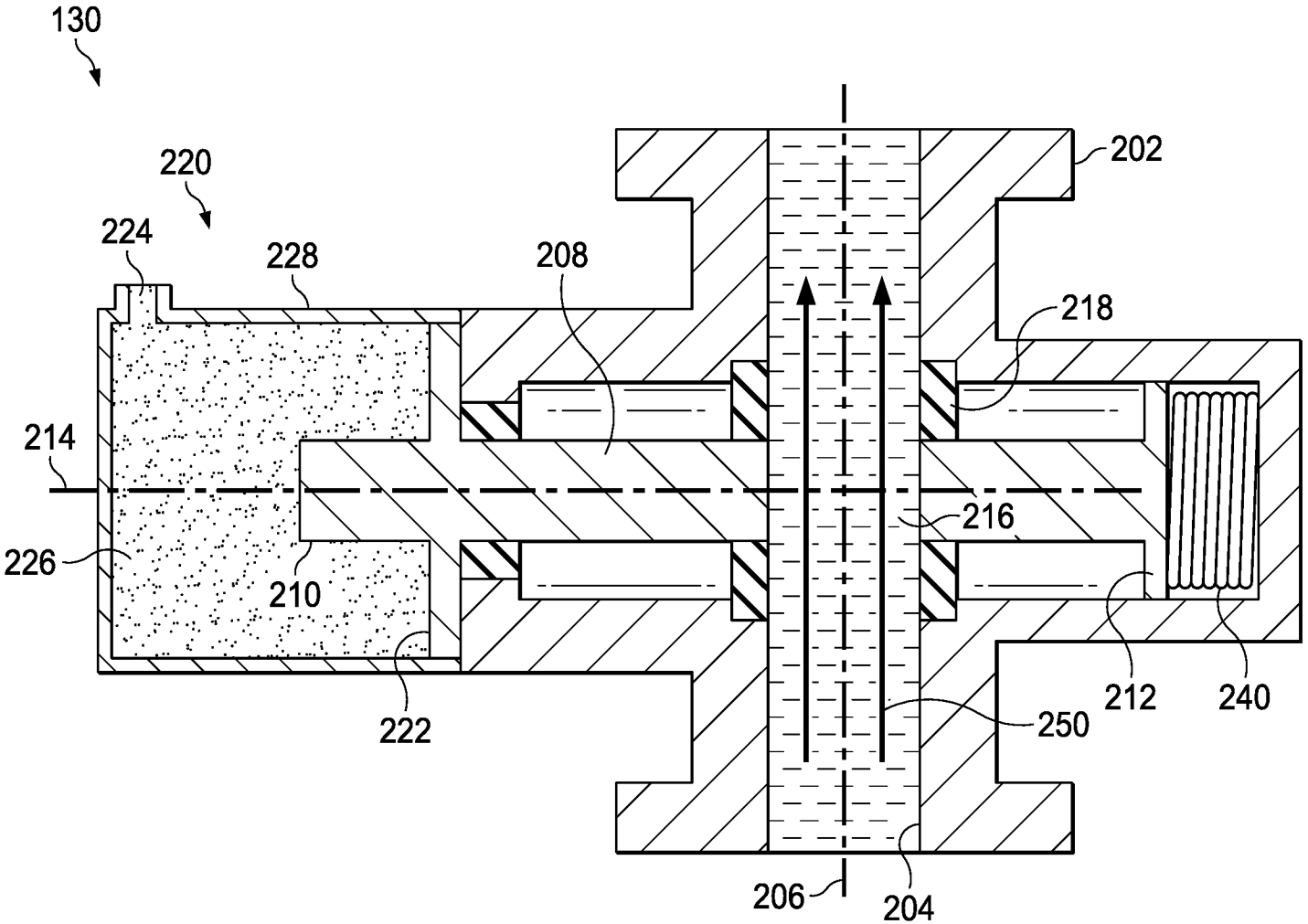
FIG. 2A is a schematic diagram of a surface safety valve in accordance with an embodiment of the present disclosure.
Figures 2B, 3:
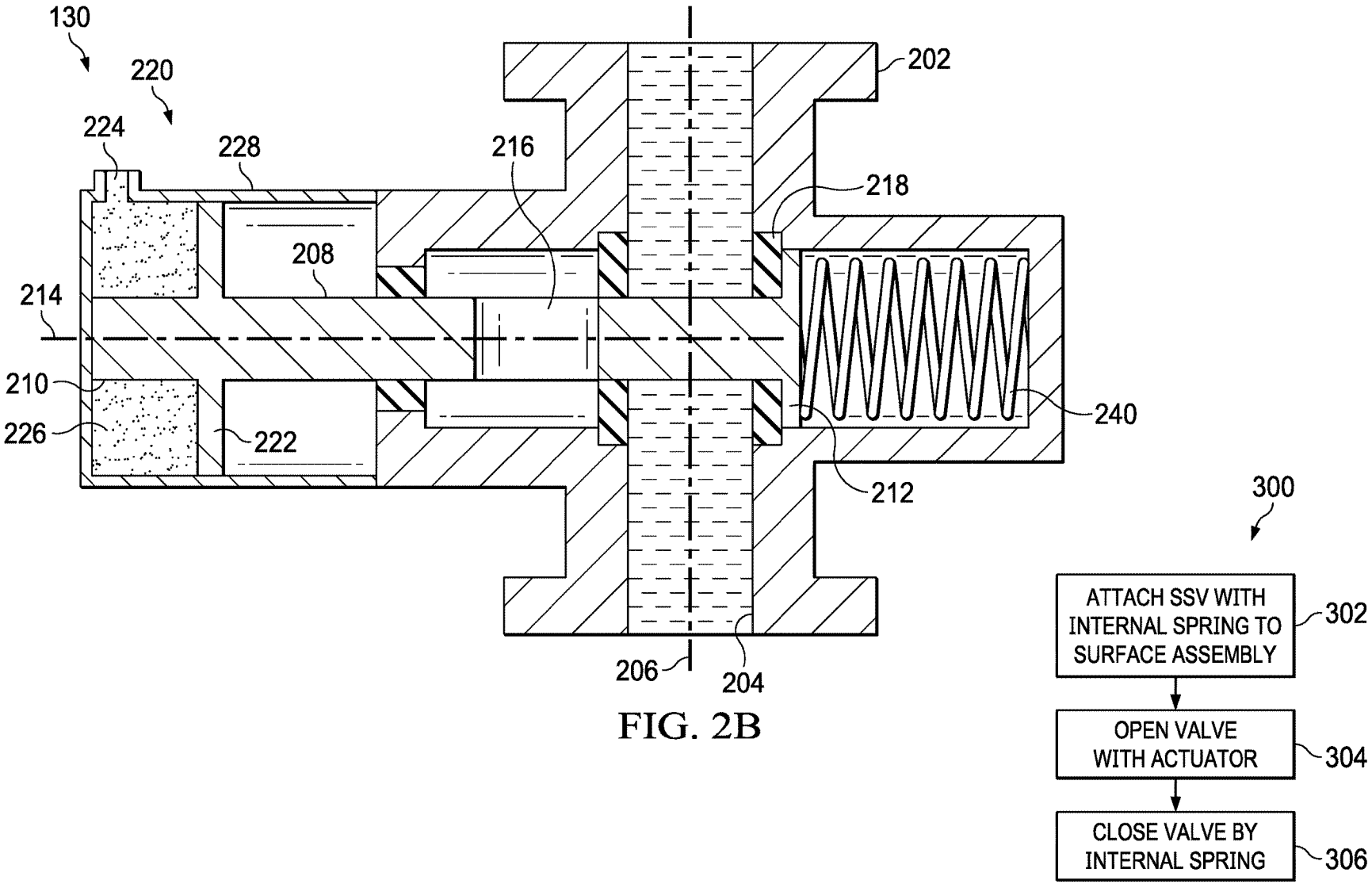
FIG. 2B is a schematic diagram of a surface safety valve in accordance with an embodiment of the present disclosure.
FIG. 3 is a process flow diagram of a method of operating a surface safety valve in accordance with an embodiment of the present disclosure.

FIGS. 2A and 2B are schematic illustrations of the SSV 130 of FIG. 1 in accordance with an embodiment of the present disclosure. Referring to FIG. 2A, SSV 130 includes a main valve body 202 having a central bore 204. Main valve body 202 can be made of stainless and/or low-carbon steel or another suitable material. In the illustrated embodiment, main valve body 202 is a one-piece housing. In some embodiments, the one-piece housing can be machined from a single piece of steel or other suitable metal. Central bore 204 is fluidically coupled to production tubing 118 such that produced wellbore fluids 250 from production tubing 118 can flow through central bore 204, either by being directly connected to production tubing 118 or indirectly via intermediate tubular components (such as, in the embodiment shown in FIG. 1, master valve 108). In the illustrated embodiment, the centerline bore axis 206 of central bore 204 is parallel with the direction of flow of wellbore fluids 250.

SSV 130 further includes a gate 208 positioned within main valve body 202 configured to move along a gate movement axis 214 between an open position and a closed position. In the open position, as shown in FIG. 2A, gate 208 does not block flow of wellbore fluids 250 through central bore 204. In the illustrated embodiment, gate 208 includes a gate passageway 216 through which wellbore fluids 250 flow when gate 208 is in the open position. In the closed position, as shown in FIG. 2B, gate 208 blocks the flow of wellbore fluid 250 through central bore 204. Seals 218 prevent the migration of wellbore fluids 250 around gate 208 when in the closed position. In the illustrated embodiment, gate movement axis 214 is perpendicular to centerline bore axis 206. Gate 208 has a gate front end 210 is on one side of centerline bore axis 206 and a gate back end 212 on the other (opposite) side of centerline bore axis 206.

In the illustrated embodiment, SSV 130 further includes an actuator 220 positioned on the same side of centerline bore axis 206 as gate front end 210. Actuator 220 can selectively push gate 208 towards the open position by applying force to gate front end 210. In the illustrated embodiment, actuator 220 is a hydraulic cylinder and includes a piston 222 and a barrel 226 enclosed by an external actuator housing 228. Force for opening gate 208 is applied by injecting hydraulic pressure via a hydraulic line (not shown) into barrel 226 via inlet 224, which causes piston 222 to push gate 208 to the open position. On other embodiments, actuator 220 can be an electric actuator or another suitable actuator or actuator system.

SSV 130 further includes a spring 240 located within main valve body 202 on the opposite side of centerline bore axis 206 as actuator 220 and on the same side as gate back end 212. In the illustrated embodiment, spring 240 is located diametrically opposite actuator 220. Spring 240 is configured to push against gate back end 212 and biases gate 208 towards the closed position. In the illustrated embodiment, spring 240 is connected to gate back end 212 and is entirely enclosed within main valve body 202. In the illustrated embodiment, there is no spring within actuator 220 or actuator housing 228, and the only spring in SSV 130 is spring 240 within main valve body 202. In other embodiments, actuator 220 and/or actuator housing 228 can contain a spring that also biases gate 208 towards the valve to the closed position, in addition to spring 240 that is within main valve body 202.

Spring 240 can push gate 208 towards the closed position in normal operations in response to a planned cutoff or lowering of pressure or power to actuator 220, or in an emergency situation such as a catastrophic event which results in unplanned power or pressure loss or damage to hydraulic or power components. Because of spring 240's location within main valve body 202, damage to actuator 220 and/or actuator housing 228 or disconnection of actuator 220 and/or actuator housing 228 from main housing 202 (due to, for example, impact from objects at the wellsite) does not affect spring 240 and spring 240 remains operable to bias gate 208 to the closed position notwithstanding such damage or disconnection.

In some embodiments, activation or and/or other control of actuator 220 can be via an intelligent control and/or supervisory control and data acquisition (SCADA) system. In some embodiments, an operator can use the SCADA system to operate solenoids to control the flow of hydraulic fluid to SSV 130 and to record pressure, temperature, and other measured parameters. For example, an operator could send signal to the SCADA system to increase hydraulic pressure to open SSV 130 and to reduce or release hydraulic pressure to closed SSV 130. For example, the SCADA system can initiate a closure sequence in the response to receiving a signal from a fire sensor on the rig that a fire is present. In some embodiments, the SCADA system may trigger audible or visual alarms before closure occurs, to indicate that an automatic shutdown is imminent.

In some embodiments, sensors to detect erosion and/or heat can be incorporated into SSV 130. In such embodiments, for example, closure of SSV 130 can be in response to an indication received by the SCADA system that a temperature measured by a temperatures sensor within SSV 130 exceeds a predetermined temperature limit.

FIG. 3 is a process flow diagram of a method 300 of operating a SSV system in accordance with an embodiment of the present disclosure. The method begins with step 302 wherein a SSV such as SSV 130 described in reference to FIGS. 2A and 2B is connected to a surface system at a wellsite such as surface system 122 described in reference to FIG. 1. As described in reference to FIGS. 2A and 2B, surface safety valve 130 includes a spring 240 (such as, for example, a coil spring) enclosed within a main valve body 202, on the opposite side of the centerline bore axis 206 from an actuator 220. Actuator 220 is operable to selectively push a gate 208 towards an open position, in which wellbore fluids can flow through the valve (for example, via a passageway 216 in gate 208). In some embodiments, spring 240 is entirely enclosed within main valve body 202, and in some embodiments main valve body 202 is a one-piece valve body. In some embodiments, actuator 220 is a hydraulic cylinder. In other embodiments, actuator 220 can be an electric actuator or other suitable actuator.

In some embodiments, actuator 220 is enclosed within an external actuator housing 228 attached to the main valve body. Spring 240 remains operable to bias a gate 208 towards the closed position when the actuator or actuator housing are damaged or disconnected from the main valve body.

Proceeding to step 304, SSV 130 is opened by activating actuator 220, thereby pushing gate 208 to the open position. In the embodiment where actuator 220 is a hydraulic cylinder, actuator 220 is activated by charging the hydraulic cylinder with hydraulic pressure.

At step 306, in response to an emergency (such as an impact from an object which damages the actuator or other wellsite equipment), the spring enclosed within the main valve body closes the SSV. For example, in the embodiment where actuator 220 is a hydraulic cylinder, gate 208 can be closed by spring 240 in response to a loss of hydraulic pressure to the hydraulic cylinder.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Accordingly, the previously described example implementations do not define or constrain the present disclosure. Other changes, substitutions, and alterations are also possible without departing from the spirit and scope of the present disclosure.

What is claimed is:

1. A well system comprising:

a production tubing positioned within a well and configured to carry fluids produced from a subterranean zone to a wellhead at a wellsite, wherein the wellsite and the wellhead are above a surface of the Earth;

a surface assembly at the wellsite, the surface assembly above the surface of the Earth and configured to regulate a flow of fluid from the production tubing and comprising a surface safety valve connected above the wellhead, the surface safety valve comprising:

a one-piece main valve body with a central bore therethrough, the central bore comprising a centerline bore axis and fluidically coupled to the production tubing;

a gate positioned within the main valve body, the gate configured to move from an open position wherein the gate does not block flow of wellbore fluid through the central bore to a closed position wherein the gate blocks flow of wellbore fluid through the central bore, wherein the gate travels from the open position to the closed position along a gate movement axis perpendicular to the centerline bore axis, and wherein the gate comprises a gate front end positioned on a first side of the centerline bore axis and a gate back end positioned on a second side of the centerline bore axis opposite the first side;

an actuator enclosed within an external actuator housing attached to the main valve body and positioned on the first side of the centerline bore axis, the actuator configured to selectively push the gate towards the open position; and a spring entirely enclosed within the main valve body and positioned on the second side of the centerline bore axis, the spring connected to the gate back end and configured to bias the gate towards the closed position;

wherein the system is configured such that the spring remains operable to bias the gate towards the closed position when the actuator or actuator housing are damaged or disconnected from the main valve body due to impact from objects above the surface of the Earth at the wellsite.

2. The well system of claim 1, wherein the actuator comprises a hydraulic cylinder that pushes the gate towards the open position in response to a charging of the hydraulic cylinder with hydraulic pressure.

3. The well system of claim 2, wherein the spring is operable to push the gate to the closed position in response to a loss of hydraulic pressure to the hydraulic cylinder.

4. The well system of claim 1, wherein the spring is a coil spring.

5. The well system of claim 1, wherein the gate comprises a fluid passage to allow wellbore fluid flow through the gate when the gate is in the open position.

6. The well system of claim 1, wherein the actuator is an electric actuator.

7. A method comprising:

connecting a surface safety valve to a surface assembly above a wellhead at a wellsite, the wellsite, the wellhead, and the surface assembly above a surface of the Earth and the surface assembly configured to regulate a flow of wellbore fluid from a production tubing of a well, the surface safety valve comprising:

a one-piece main valve body with a central bore therethrough, the central bore comprising a centerline bore axis and fluidically coupled to the production tubing;

a gate positioned within the main valve body, the gate configured to move from an open position wherein the gate does not block flow of wellbore fluid through the central bore to a closed position wherein the gate blocks flow of wellbore fluid through the central bore, wherein the gate travels from the open position to the closed position along a gate movement axis perpendicular to the centerline bore axis, and wherein the gate comprises a gate front end positioned on a first side of the centerline bore axis and a gate back end positioned on a second side of the centerline bore axis opposite the first side;

an actuator enclosed within an external actuator housing attached to the main valve body and connected to the gate front end and positioned on the first side of the centerline bore axis, the actuator configured to selectively push the gate towards the open position; and a spring entirely enclosed within the main valve body and positioned on the second side of the centerline bore axis, the spring connected to the gate back end and configured to bias the gate towards the closed position, wherein the surface assembly is configured such that the spring remains operable to bias the gate towards the closed position when the actuator or actuator housing are damaged or disconnected from the main valve body due to impact from objects at the surface of the Earth at the wellsite;

opening the surface safety valve by activating the actuator, thereby pushing the gate to the open position.

8. The method of claim 7, wherein the actuator comprises a hydraulic cylinder and wherein activating the actuator comprises charging the hydraulic cylinder with hydraulic pressure.

9. The method of claim 8, further comprising pushing, by the spring, the gate to the closed position in response to a loss of hydraulic pressure to the hydraulic cylinder.

10. The method of claim 7, wherein the spring is a coil spring.

11. The method of claim 7, wherein the gate comprises a fluid passage to allow wellbore fluid flow through the gate when the gate is in the open position.

12. The method of claim 7, wherein the actuator is an electric actuator.

* * * * *